US006659865B1

(12) United States Patent
Eklund

(10) Patent No.: US 6,659,865 B1
(45) Date of Patent: Dec. 9, 2003

(54) INTERACTIVE GAMING DEVICE REQUIRING SENSORY INPUT

(75) Inventor: Gert Eklund, Hovås (SE)

(73) Assignee: IGS Limited, Gibraltar ( * ) Notice: Subject to any disclaimer, the term of this patent is extended or adjusted under 35 U.S.C. 154(b) by 0 days.

(21) Appl. No.: 09/582,559

(22) PCT Filed: Dec. 23, 1998

(86) PCT No.: PCT/SE98/02447

§ 371 (c)(1),
(2), (4) Date: Jun. 29, 2000

(87) PCT Pub. No.: WO99/33533

PCT Pub. Date: Jul. 8, 1999

(30) Foreign Application Priority Data

Dec. 29, 1997 (SE) ..... 9704884

(51) Int. Cl.[7] ..... A63F 13/00
(52) U.S. Cl. ..... 463/17; 463/16
(58) Field of Search ..... 463/17, 16; 150/165; 206/320

(56) References Cited

U.S. PATENT DOCUMENTS

| | | | | |
|---|---|---|---|---|
| 5,069,453 A | | 12/1991 | Koza et al. | 273/134 |
| 5,855,513 A | * | 1/1999 | Lam | 568/765 |
| 5,893,797 A | * | 4/1999 | Marino et al. | 463/17 |
| 5,931,297 A | * | 8/1999 | Weill et al. | 206/320 |
| 6,048,268 A | * | 4/2000 | Humble | 273/139 |
| 6,273,815 B1 | * | 8/2001 | Stuckman et al. | 434/238 |
| 6,287,193 B1 | * | 9/2001 | Rehkemper et al. | 273/142 H |

FOREIGN PATENT DOCUMENTS

| | | |
|---|---|---|
| DE | A-4111720 | 10/1992 |
| EP | A1647912 | 4/1995 |
| JP | A9173644 | 7/1997 |
| WO | A1-9422113 | 9/1994 |
| WO | A1-9700783 | 1/1997 |

* cited by examiner

*Primary Examiner*—Jessica Harrison
*Assistant Examiner*—Corbett B Coburn
(74) *Attorney, Agent, or Firm*—Birch, Stewart, Kolasch & Birch, LLP

(57) ABSTRACT

The invention relates to an interactive gaming device (100) which contains information concerning whether the device can be made to award a prize or not. The device includes modules (1,2,3,4,5,10,20,30,40,50,60,70) for interaction with a user, and is provided with information unknown to the user concerning how a user is to interact with the device (100) in order for a device which can award a prize to award a prize. This information can relate to whether the device is a winner or not in a lottery. The modules of interaction with a user can comprise a control unit (70), sensors (1,2,3,4,5) for detecting at least one of the parameters sound, light, temperature, touch, atmospheric pressure and movement of the device, and in addition modules (10,20,30,40,50) for example light emitting diodes, of indicating correct interaction with the device with regard to each one of the parameters which the device is equipped with sensors to detect.

16 Claims, 3 Drawing Sheets

INTERACTIVE GAMING DEVICE REQUIRING SENSORY INPUT

This application is the national phase under 35 U.S.C. §371 of PCT International Application No. PCT/SE98/02447 which has an International filing date of Dec. 23, 1998, which designated the United States of America.

TECHNICAL FIELD

The present invention relates to a gaming device which based on information in the device and the user's interaction with the device can award a prize or not.

CURRENT TECHNOLOGY

The aim of games and lotteries is usually to give the participants a measure of excitement at the same time as giving them the chance to win a prize, for example a sum of money. The usual procedure is that the participants wager a sum of money or buy a lottery ticket, subsequent to which, after a certain period of time, the participants are informed or can find out for themselves whether they have won or not. This procedure provides, as mentioned, a certain amount of excitement, but does not provide the participants with any significant degree of interactivity which would increase the participants' excitement and involvement.

One type of lottery ticket which gives the participant a somewhat greater degree of interactivity are so-called scratch cards. A previously determined game plan comprising a network of squares is covered by a substance which can easily be scratched off. The user scratches off the coating one square at a time and if the game plan turns out to contain certain combinations a prize is won. A disadvantage of scratch cards is that it could be said to be relatively easy to cheat with them, and that they do not increase the participant's excitement and involvement to a significant extent compared to traditional lotteries.

There are also games and lotteries which give the participants a certain degree of interactivity beyond what is described above. For example, there are TV and radio programmes in association with which the public can buy lottery tickets, questionnaires or the like, which are then filled in based on questions or other types of information provided in the programme. Participants who have won, or who believe they have won, can then for example ring a telephone number in order to claim their prize and/or obtain further questions.

Document EP 647 912 discloses a device which is intended to be used at certain predetermined times in connection with a radio or TV programme, or other event, for example a sporting event. The user can see clearly what activities must be performed in order to win a prize and at what times these activities must be performed.

Document WO 94/22113 describes a device which could be said to be an electronic lottery card, where the actual drawing of the lots is carried out electronically, preferably using a signal which is transmitted via TV or radio. In other words, this device appears to be arranged to carry out a lottery of the traditional type using electronics.

SUMMARY OF THE INVENTION

The problem solved by this invention is to provide a device for use in gaming and lotteries, which device increases the participants' involvement and perceived excitement through interactivity.

This problem is solved using a gaming device which is equipped with means of interaction with a user. The means of interaction comprise means of detection of the user's interaction with the device, means of indicating various states of the device and a control unit.

The device's control unit contains information regarding whether the device can be influenced to award a prize or not, and contains further information concerning how a user is to interact with the device in order to make a device which can award a prize award a prize.

The information concerning whether a device according to the invention can award a prize, and the information about how the user is to interact with the device in order to make a device which can award a prize award a prize, is unknown to the user. The user knows what parameters the interaction with the device involves, but not how the interaction relating to these parameters is to take place.

An example of a parameter for interaction with the device is temperature. The user knows that the interaction with the device concerns temperature, but does not know whether the device is to be subjected to high or low temperatures or for how long a time.

Examples of other parameters for interaction with the device could be sound, light, touch, atmospheric pressure and movement of the device.

The device is, as mentioned, provided with means for indication. In the event of correct interaction, this will be indicated and the user continues by attempting to interact with the device for another parameter. When there has been correct interaction for all parameters, this is indicated.

It is only possible to interact with the device during certain periods, and the device is provided with means of indicating to the user when these periods occur.

Devices which cannot award prizes cannot be interacted with for all the parameters.

As the user does not know how the device is to be interacted with for the various parameters and, if relevant, does not know when the next period for interaction will occur, a large degree of attention and interactivity will be required.

In order to make improper manipulation more difficult, the device is, in a preferred embodiment completely encased in a material which is difficult to penetrate.

DESCRIPTION OF THE FIGURES

In the following the invention will be described in greater detail, utilizing examples of preferred embodiments and with reference to the appended figures, where.

PREFERRED EMBODIMENTS

Figure 1:
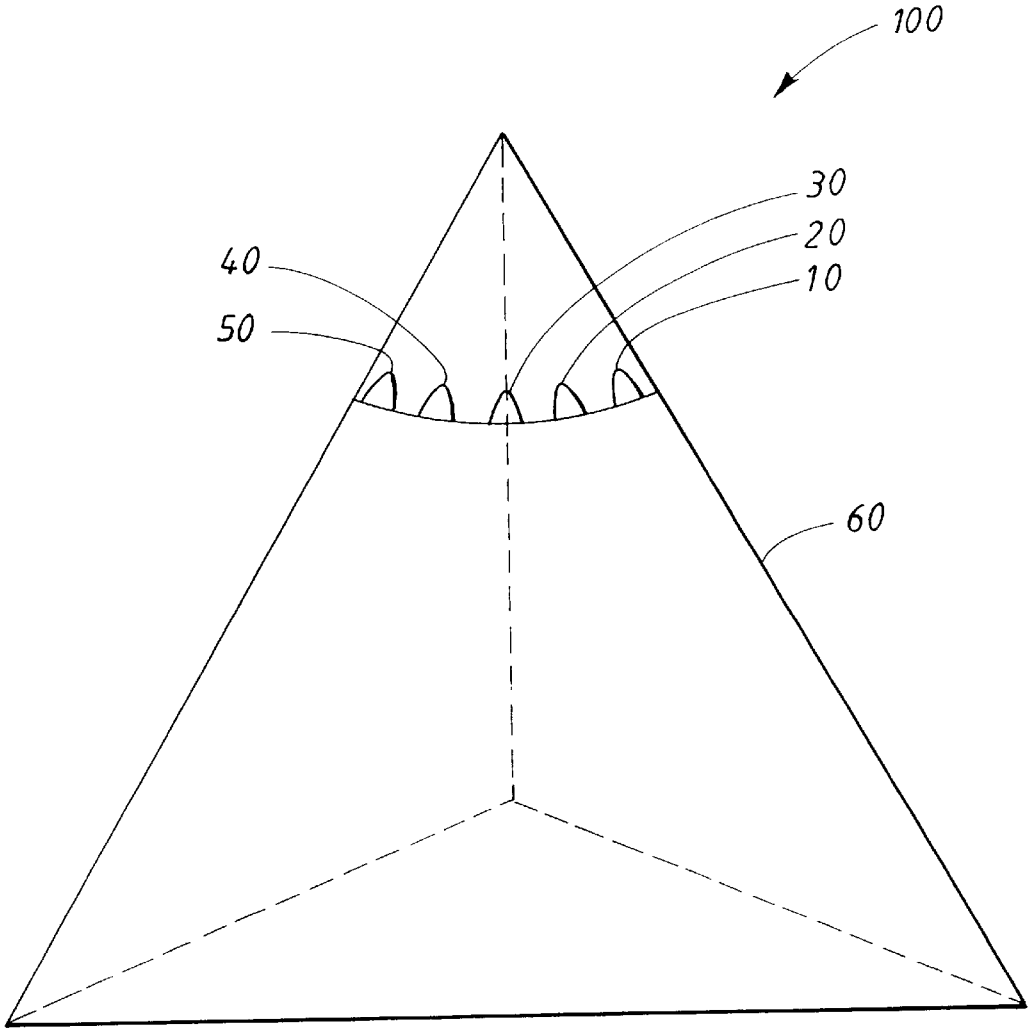
FIG. 1 shows a sketch of the invention in a preferred embodiment.

FIG. 1 shows a device according to the invention in a preferred embodiment. As shown by the figure, in this embodiment the invention consists of a pyramid-shaped device 100. The device 100 is equipped with means 10,20, 30,40,50 for communication with the user, which can preferably consist of light emitting diodes. All the components in the device 100 are encapsulated in a casing 60, moulded in one piece, which makes the device very difficult to manipulate fraudulently. At least that part of the casing 60 which covers the light emitting diodes is transparent.

Figure 2:
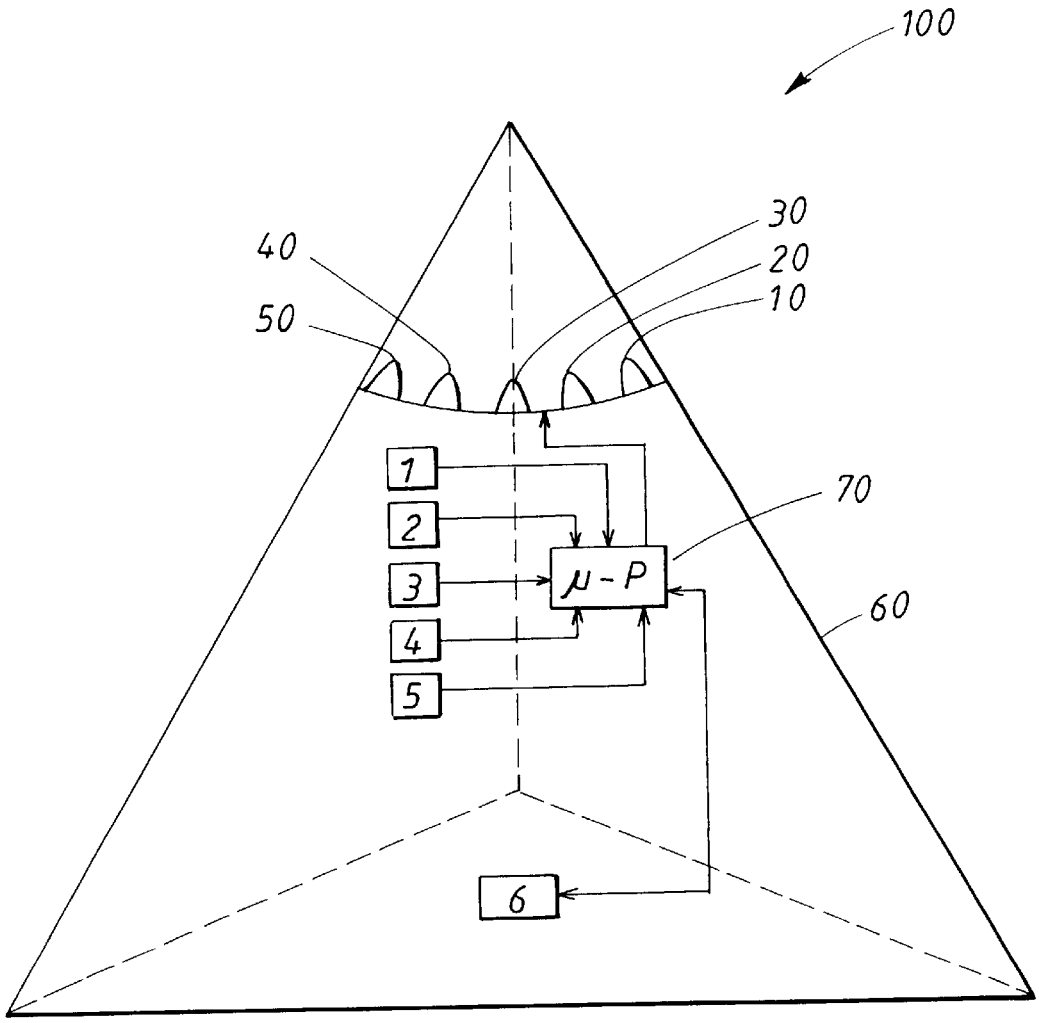
FIG. 2 shows a sketch of the invention in the same embodiment as in FIG. 1, but with certain components symbolically indicated.

FIG. 2 shows a symbolic exploded view of the same device as shown in FIG. 1. The device comprises a control unit 70, in the example a microprocessor which is equipped with a memory and a power source (not shown). If the microprocessor does not comprise a clock function, the device 100 can comprise a clock circuit (not shown) which can be connected to the microprocessor. The microprocessor 70 controls the function of the device 100, which will be described in greater detail below.

As also shown in FIG. 2, the device 100 is equipped with a number of sensors 1,2,3,4,5 which constitute the device's "senses". Preferably each sensor 1,2,3,4,5 is used to detect one of the parameters by which a user can interact with the device 100. The number of sensors is of course arbitrary, as are the parameters which the sensors are able to detect. Examples of parameters by which the user can interact with the device are sound, light, temperature, touch, atmospheric pressure and movement of the device.

The sensors 1,2,3,4,5 in the device 100 are connected to the microprocessor 70. In a preferred embodiment, information is stored in the microprocessor or in its memory about whether the device 100 can award a prize in a lottery. This information can either be stored in the microprocessor 70 when the device is manufactured, or calculated by the microprocessor at a later occasion, for example when the device is sold.

In addition, information is stored in the microprocessor 70 concerning how the user is to interact with that particular device 100 with regard to each parameter, in other words with regard to each one of the device's "senses". A device which can award a prize in the said lottery, and which is interacted with correctly with regard to the parameters which can be detected by the device's sensors will award a prize, which will be described in greater detail below.

A device which cannot award a prize in said lottery will not be able to be interacted with for all its senses, and will in other words not be able to be made to award a prize. This can be achieved either by devices which cannot award prizes not being equipped with all the "senses", or by devices which cannot award prizes not activating all the "senses".

In an alternative embodiment it could be possible for each individual device to award a prize if it is interacted with in the correct way. In such an embodiment, the device could not be said to be part of a traditional lottery.

In addition to the components described above, the device also comprises means 6 for activating and checking, which means can be used to activate the device 100, and at a later stage to check whether the device should award a prize. The means 6 for activating and checking the device is also connected to the microprocessor 70. The means 6 for activating and checking can consist of a mechanical contact, or in a preferred embodiment, a means for transmitting and receiving IR light. Activating and checking the device can of course be carried out in a large number of other ways known to those skilled in the field, for example by acoustic signalling.

The user can only interact with the device 100 during certain periods, which will be described in greater detail in connection with the time diagram shown in FIG. 3.

Activation of the device 100 and checking on prizes is preferably carried out by a retailer, using the IR equipment described above and the IR equipment of the retailer, which interacts with this.

Figure 3:
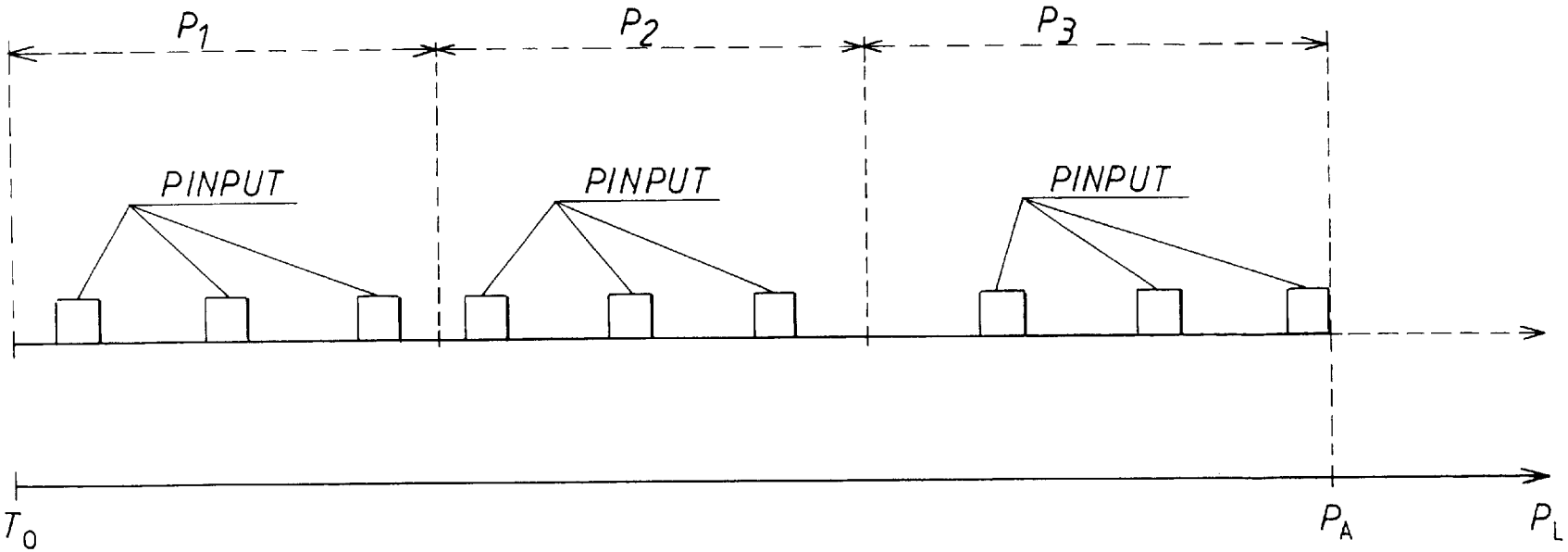
FIG. 3 shows various periods, and activities connected with the periods, for a device according to the invention.

FIG. 3 shows examples of various periods and activities associated with these periods for the device. These periods are preferably controlled by the microprocessor 70. In order to clarify how the device 100 is intended to function, the periods will be described in connection with a possible course of events.

The device 100 is activated for use at a time $T_0$. This activation suitably takes place at the premises of a retailer in connection with the purchase of the device. In a device which at the time of manufacture has not been provided with information concerning whether the device can be made to award a prize or not, this information can suitably be calculated by the microprocessor upon activation.

From the time of activation the device 100 has a lifetime $P_L$. During all or part of this lifetime, in addition, the device has an active time $P_A$. The active time $P_A$ is divided into a number of periods $P_1$–$P_N$ which are suitably of equal length. FIG. 3 shows three periods $P_1$–$P_3$, where the number of course is only one example of the number of periods, N.

During each period $P_1$–$P_N$ the device 100 will be "open" for interaction with a user during a number of shorter periods $P_{input}$. The times when the interaction periods $P_{input}$ are to occur during each period $P_1$–$P_N$. are controlled by the microprocessor, with the start of the first interaction period $P_1$ being selected at random. The other interaction periods in the same period $P_1$–$P_N$ can suitably be controlled to occur regularly during the period.

In a preferred embodiment, the periods $P_1$–$P_N$ are twelve hours long and the interaction periods $P_{input}$ are one hour long. If a first interaction period $P_{input}$ occurs during hour 1 in a twelve-hour period, the other two interaction periods $P_{input}$ will in other words occur during hour 5 and hour 9 during the twelve-hour period. If a first interaction period $P_{input}$ occurs during hour 2 in a twelve-hour period, the other two interaction periods $P_{input}$ will in other words occur during hour 6 and hour 10 during the twelve-hour period, and so on.

To enable the user to know the current state of the device 100, for example whether interaction can take place or not, the light emitting diodes 10,20,30,40,50 are used to indicate the state of the device 100. Active periods can for example be indicated by the middle light emitting diode 30 being lit every twenty seconds (0.05 Hz) and remaining lit for a short interval, for example 125 ms.

When the interaction periods $P_{input}$ occur, this is indicated in the preferred embodiment by the same light emitting diode 30 which indicates active periods. Indication of interaction periods is carried out by this light emitting diode 30 being lit at shorter intervals, for example every two seconds (0.5 Hz).

In other words, the middle light emitting diode 30 is used to indicate the status of the device 100 with regard to whether there can be interaction with the device or not. Other light emitting diodes 10,20,40,50 are used to indicate that correct interaction has occurred, where each light emitting diode 10,20,40,50 is suitably connected to a "sense". When correct interaction has occurred, the light emitting diode for the corresponding sense indicates this, suitably by flashing at the same frequency as the middle light emitting diode 30, but displaced, "staggered", in time.

The expression "correct interaction" is used to mean that one of the device's "senses" 1,2,3,4,5 has been interacted with in the way that is stored in the microprocessor. The user knows which "senses" 1,2,3,4,5 the device is equipped with, but does not know how the interaction with these is to be carried out.

The parameter temperature can be used to describe in greater detail what is meant by correct "interaction". Information is stored in the memory of the microprocessor 70 concerning a particular temperature range and a particular shortest and possibly also a particular longest interval of time. In order for the device's 100 sense "temperature" to be considered to be interacted with correctly, the device 100 must be subjected to a temperature which lies within the said range. The device 100 must in addition be subjected to this "correct" temperature for a length of time which exceeds the said shortest period of time. Where applicable the device 100 must not be subjected to the "correct" temperature for a period of time which exceeds the said longest period of time.

In a similar way, the device 100 contains information about within what range and for what periods of time the interaction with the device is to occur for every single one of the device's "senses". Because the user does not know this information, and because this information is different for different individual devices, a large element of excitement is created, along with a high degree of interactivity.

"Correct interaction" does not of course need to be continual interaction relating to a particular parameter. It is also possible that for one or more of the parameters the user must instead during one and the same interaction period $P_{input}$ interact with the device according to a certain sequence. It is also possible that "correct interaction" can comprise interaction which does not originate directly from the user, if for example the device is to be subjected to a certain interaction or sequence of interactions which are for example transmitted via TV or radio.

If some but not all of the senses have had the correct interaction during the interaction periods $P_{input}$ which occur during one and the same period $P_1$–$P_N$, in a preferred embodiment the senses that had the correct interaction will be "reset to zero" before the next period $P_1$–$P_N$, in other words all the senses must be interacted with correctly during one and the same period $P_1$–$P_N$.

In the event of correct interaction with all the senses during one and the same period $P_1$–$P_N$ this will be indicated, in the preferred embodiment by the light emitting diodes 10,20,40,50 for all the senses flashing with a certain frequency, for example 1 Hz. This indication continues throughout the whole active period of the device $P_A$, after which the light emitting diodes 10,20,40,50 change to flashing with a considerably lower frequency throughout the time remaining of the lifetime $P_L$ of the device 100. Correct interaction with all the senses during one and the same period $P_1$–$P_N$ will also be stored in the memory of the microprocessor 70 for later checking.

During that part of the lifetime $P_L$ of the device 100 which passes after the device's active period $P_A$ is concluded, it will still be possible to check the device with regard to prize/no prize, which can be carried out suitably at the premises of a retailer and is carried out via the IR equipment 6. As mentioned above, there are two alternative embodiments of the device, one where each device can be made to award a prize and one where each device contains a particular probability of a prize in a lottery. In the latter embodiment it is possible that a device which has not been interacted with correctly but which can award a prize in a lottery can state this when it is being checked, upon which a prize is awarded.

It is possible to have an alternative embodiment with a greater degree of difficulty than that described above, where each device is equipped with a number of senses which number is only a partial quantity of a larger number. The user can in such an embodiment know, for example, that there are six senses in all, and that each device is provided with four of these senses, but the user does not know which four senses his particular device is equipped with.

For the sake of clarity it should be mentioned that the power source of the microprocessor can be a battery, solar cell, mains power or the like.

Finally it should be clarified what is meant by the expression "award a prize", which has been used throughout above. The expression "award a prize" is, in a preferred embodiment, used to mean that the device has been interacted with in such a way that a prize, for example a sum of money, can be awarded if it is shown that the "correct interaction" which has been described above has taken place when the device is checked by a retailer.

However, it is of course possible that a user who has interacted with his device in the "correct" way, and who can prove this, will receive some other type of reward or encouragement.

This invention is not limited to the embodiments described above but can be varied freely within the framework of the following patent claims. The time values of the periods which have been described above are of course only intended as examples.

As a means of signalling to the user it is possible to have completely means different to light emitting diodes, for example a liquid crystal display (LCD) or acoustic signalling.

As the control unit in the device it is possible to have means other than a microprocessor, for example mechanical control devices.

The pyramid shape which the device has been given in the drawings can of course be varied without deviating from the invention.

In the description above, it is stated that the device is controlled via a control unit situated in the device. In an alternative embodiment the device can be wholly or partially controlled by remote control, for example by signalling in connection with a radio or TV programme. This signalling can, for example, be perceived by the device's existing "senses".

What is claimed is:

1. Interactive gaming device which includes a first information concerning whether the device can be made to award a prize or not, which device comprises:

means for interaction with a user wherein the device is provided with a second information unknown to the user concerning the manner in which a user is to interact with the device; and means for controlling the means for interaction with the user.

2. Interactive gaming device according to claim 1, wherein the first information concerning whether the device can be made to award a prize or not consists of information concerning whether the device is a winner or not in a lottery.

3. Interactive gaming device according to claim 1, wherein the device's control unit is used to give the device a certain predetermined lifetime $P_L$, a certain predetermined active period of time $P_A$ which occurs during the lifetime $P_L$ of the device, and contains one or more groups of the periods of time $P_{input}$ during which the user can interact with the device, whereby correct interaction with all parameters must take place within a group in order for a prize to be awarded, and in that the device is equipped with means of indicating that the device is in its active period of time $P_A$.

4. Interactive gaming device according to claim 1, wherein the means of interaction with a user comprises sensors for detecting at least one of the following parameters:

sound, light, temperature, touch, atmospheric pressure, movement of the device.

5. Interactive gaming device according to claim 4, in which device the means of interaction comprises means of indicating correct interaction with the device concerning each single one of the parameters which the device is equipped with sensors to detect.

6. Interactive gaming device according to claim 5, wherein the abovementioned means of indication comprise light emitting diodes.

7. Interactive gaming device according to claim 1, wherein the interaction with the user can only take place during certain periods of time ($P_{input}$), and that the device comprises means for controlling when these periods of time are to occur.

8. Interactive gaming device according to claim 7, in which device the control unit is used to control during which periods of time ($P_{input}$) interaction is to be able to take place.

9. Interactive gaming device according to claim 7, in which device the means of controlling during which periods of time ($P_{input}$) interaction is to be able to take place comprises means for remote control, whereby the periods of time ($P_{input}$) can be controlled from a central location.

10. Interactive gaming device according to claim 7, wherein the device comprises means of indicating that the abovementioned periods of time for interaction are occurring.

11. Interactive gaming device according to claim 1, in which the device's control means comprises a microprocessor, with an associated memory and power source, in which the microprocessor is connected to the abovementioned sensors and contains first and second information concerning:

whether the device can be made to award a prize or not, how the interaction of the user with the device is to take place in order for the device to award a prize.

12. Device according to claim 1, wherein the device is equipped with means for a retailer to activate the device and to check whether the device is a winner or not.

13. Device according to claim 1, wherein all components in the device are encapsulated in a casing molded in one piece, which casing is transparent at least where it cover means of indication.

14. An interactive gaming device for awarding a prize to a user, the device comprising:

at least one module for detecting at least one parameter for interaction, wherein when a predetermined number of parameters is satisfied, a prize is awarded and wherein the user does not know the manner in which to interact with the device;

a controller for controlling the at least one module; and at least one indication wherein when at least one parameter is satisfied, the indication is activated.

15. The interactive gaming device of claim 14, wherein the user does not know what the at least one parameter for interaction is and further does not know how to satisfy the at least one parameter.

16. The interactive gaming device of claim 14, wherein at least parameter may including at least one of sound, light, temperature, touch, atmospheric pressure and movement.

* * * * *